US005584418A

United States Patent [19]

Schroeder et al.

[11] Patent Number: 5,584,418

[45] Date of Patent: Dec. 17, 1996

[54] FLEXIBLE CONTAINER HAVING DISPENSING HEAD WITH EXPOSED SHOULDER

[75] Inventors: Robert W. Schroeder, Northampton; William B. Kenyon, Jr., Easthampton; James T. Farley, Jr., Agawam; Russell P. Cisek, South Hadley, all of Mass.

[73] Assignee: Tubed Products, Inc., Easthampton, Mass.

[21] Appl. No.: 216,949

[22] Filed: Mar. 24, 1994

[51] Int. Cl.[6] ..... B65D 37/00

[52] U.S. Cl. ..... 222/92; 222/107; 222/212; 222/215

[58] Field of Search ..... 222/206, 212, 222/215, 92, 107

[56] References Cited

U.S. PATENT DOCUMENTS 4,473,097 9/1984 Knickerbocker et al. ..... 202/215 X
4,638,927 1/1987 Morane ..... 222/215 X
5,285,933 2/1994 Gentes et al. ..... 222/212 X

FOREIGN PATENT DOCUMENTS 733653 7/1955 United Kingdom ..... 222/215

*Primary Examiner*—Andres Kashnikow
*Assistant Examiner*—Joseph A. Kaufman
*Attorney, Agent, or Firm*—Oblon, Spivak, McClelland, Maier & Neustadt, P.C.

[57] ABSTRACT

A flexible container for dispensing a fluid product includes a flexible tube-like sleeve having a closed end and a head end, as well as a dispensing head secured to the head end of the sleeve. The dispensing head includes a tip portion having an aperture for discharge of a fluid product in the container, and a substantially truncated conical base portion extending radially outwardly from the tip portion so as to define a substantially annular shoulder portion. A depending portion depends from the shoulder portion and extends generally away from the tip portion. The headed end of the sleeve is secured to, and terminates at, the depending portion.

19 Claims, 2 Drawing Sheets

FLEXIBLE CONTAINER HAVING DISPENSING HEAD WITH EXPOSED SHOULDER

BACKGROUND OF THE INVENTION

1. Field of the Invention

The present invention is directed to flexible containers formed of a flexible tube-shaped sleeve and a dispensing head secured thereto. More particularly, the present invention is directed to such a flexible container in which the dispensing head is secured to the sleeve such that the shoulder of the dispensing head remains uncovered by the sleeve.

2. Description of the Related Art

Flexible dispensing containers are well known in which a tube containing a product, which may be a liquid, viscous liquid or flowable particulate solid, may be squeezed to dispense the product from a dispensing head of the tube. It has been known to form the container from a blow molded plastic. However, this has the drawback that since the dispensing head and the sleeve are formed simultaneously, they are restricted to having the same color, texture, and so on. This limits the aesthetic variety available for the containers.

An example of another conventional container is shown in FIGS. 1 and 2. This conventional container has two major components, a flexible tube-like sleeve 10 and a dispensing head 20. The flexible sleeve and the dispensing head are secured together to form a unitary container. The flexible sleeve 10 may be formed of an extruded plastic such as low density polyethylene, high density polyethylene, linear low density polyethylene, polypropylene, and blends thereof. Sections of the extruded sleeve are cut to length and placed in a compression or injection mold in which the unitary dispensing head 20 is to be formed. The dispensing head 20 is formed of a moldable plastic which may be the same as that of the sleeve, and is molded i.e., non-removably secured, to the sleeve 10 by virtue of the molding operation.

The dispensing head typically has a substantially cylindrical tip portion 30 and a substantially truncated conical base portion 40. The tip portion may have an aperture 32 through which product such as a fluid may be dispensed, and screw threads 34 for attachment of a cap.

The radially outer perimeter of the base portion 40 merges with the head end of the sleeve to form a smoothly rounded shoulder 44 at the joint 50 between the dispensing head and the sleeve. Typically, the sleeve extends over the perimeter of the dispensing head so as to define the majority of the arcuate extent of the shoulder, except for about the 30° of arc of the shoulder closest to the truncated cone surface 42. This has been found to be an adequate overlap of the sleeve and dispensing head to provide a good seal between the two.

Such a two piece container has advantages over a one piece blow molded container since the dispensing head may have a different color, texture, etc. than the sleeve. However, it has the following drawback:

It is normally necessary or desirable to provide art work, a logo, text or descriptive indicia (any of these hereinafter simply referred to as indicia) on the container for aesthetic, advertising or informational purposes. However, due to the extruded nature of the sleeve 10, such indicia are typically printed on the sleeve. It is not possible to inexpensively provide such indicia on the sleeve using embossed or recessed characters on the extruded tube.

Forming embossed or recessed indicia on the dispensing head is still easily done since it is a molded product. However, such indicia are restricted to the truncated conical surface 42 since the shoulder 44 is covered by the sleeve. This, in turn limits the cap size such that the truncated conical surface 42 is left exposed, and so wide caps cannot be used.

It has become necessary, in recent years, to provide containers for products intended for human consumption or personal use with safety seals to assure that the product has not been tampered with prior to use. In the case of such flexible containers it is common to apply a shrink wrap onto the capped container, so that a consumer will known that the cap has not been removed so long as the shrink wrap is intact. For both environmental and cost reasons, however, it would be desirable to reduce the amount of shrink wrap which must be used for each container.

SUMMARY OF THE INVENTION

It is therefore an object of the present invention to overcome the foregoing shortcomings of the conventional art.

It is a further object of the invention to provide a flexible container having greater flexibility in accepting embossed or recessed indicia without restriction as to colors or textures of the sleeve and dispensing head.

It is yet a further object of the invention to provide a flexible container capable of accepting a tamper resistant shrink wrap without the need for covering the entire container with the shrink wrap.

According to one feature of the invention, the above and other objects are achieved by a flexible container for dispensing a product contained therein, and comprising a flexible tube-shaped sleeve having a closed end and a head end, as well as a dispensing head secured to the head end of the sleeve. The dispensing head comprises a tip portion for discharge of a fluid product in the container, a substantially truncated conical base portion extending from the tip portion so as to define a substantially annular shoulder portion at an outer periphery thereof, and a depending portion depending from the shoulder portion and extending generally away from the tip portion. The headed end of the sleeve is secured to, and terminates at, the depending portion so that the shoulder portion is uncovered by the sleeve.

According to a further feature of the invention, the depending portion defines an annular undercut portion at a side of the shoulder portion opposite the tip portion, the undercut portion being uncovered by the sleeve and having a diameter less than a maximum diameter of the shoulder portion.

According to a further feature of the invention, indicia are molded on at least the shoulder portion.

According to yet a further feature of the invention, the container includes a cap covering the tip portion, and a plastic shrink wrap material covering the cap and extending into the undercut portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 2:
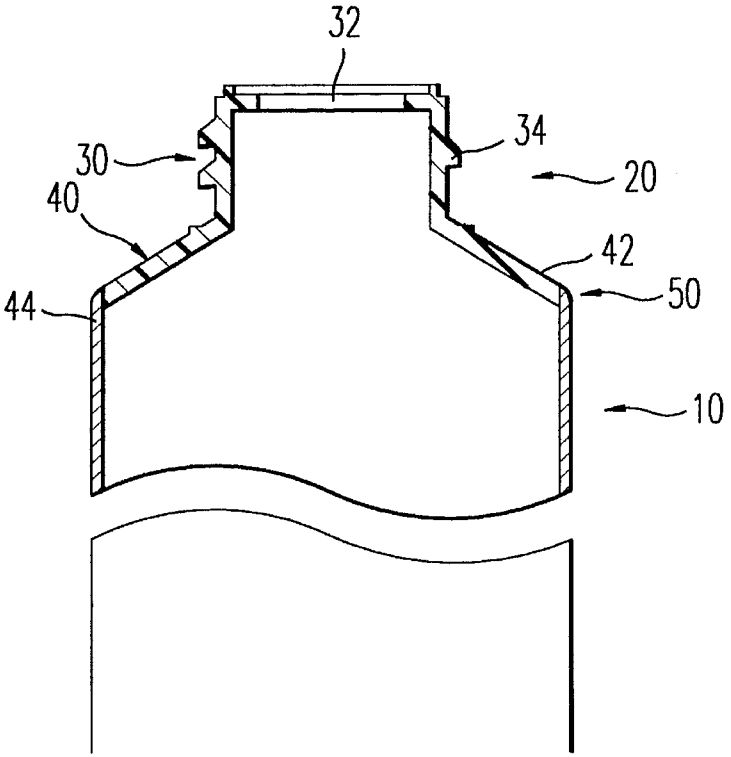
FIG. 2 PRIOR ART
FIG. 2 is a partial sectional view of the container of FIG. 1.

Preferred embodiments of the invention will now be described with reference to the attached figures in which the same reference numerals are used to refer to the same or corresponding parts throughout the several views.

Figure 1:
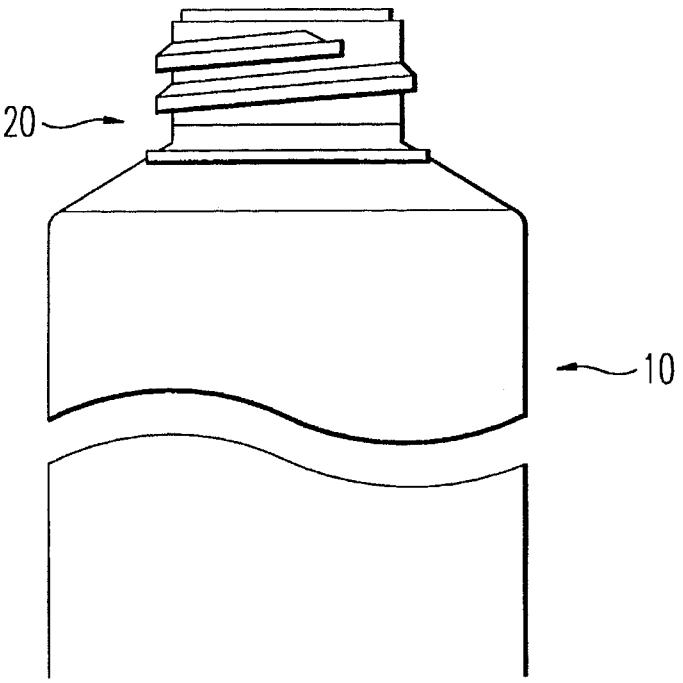
FIG. 1 PRIOR ART
FIG. 1 is a partial elevation of a conventional container.
Figure 5:
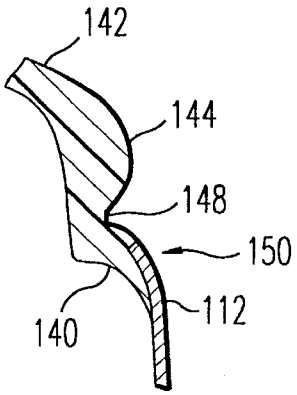
FIG. 5 is a detail of the joint portion in FIG. 4.
Figure 4:
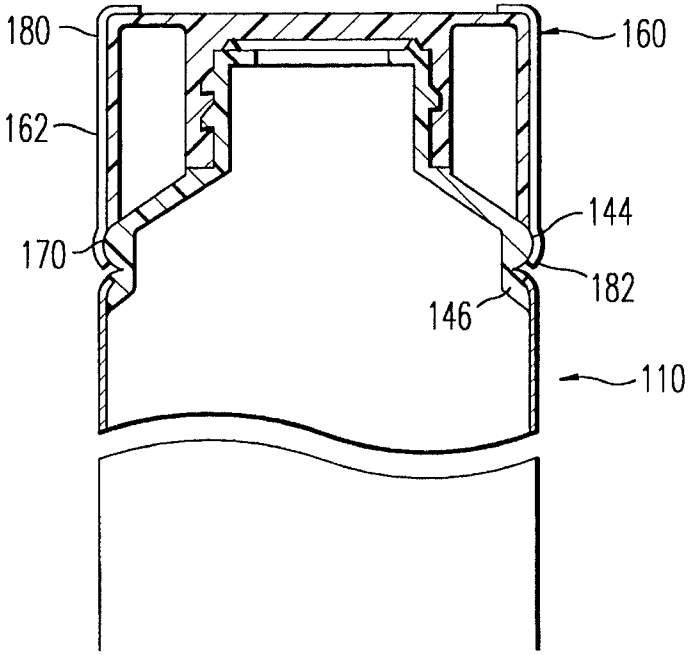
FIG. 4 is a partial sectional view of the container of FIG. 3 having a cap and shrink wrap mounted thereon.
Figure 3:
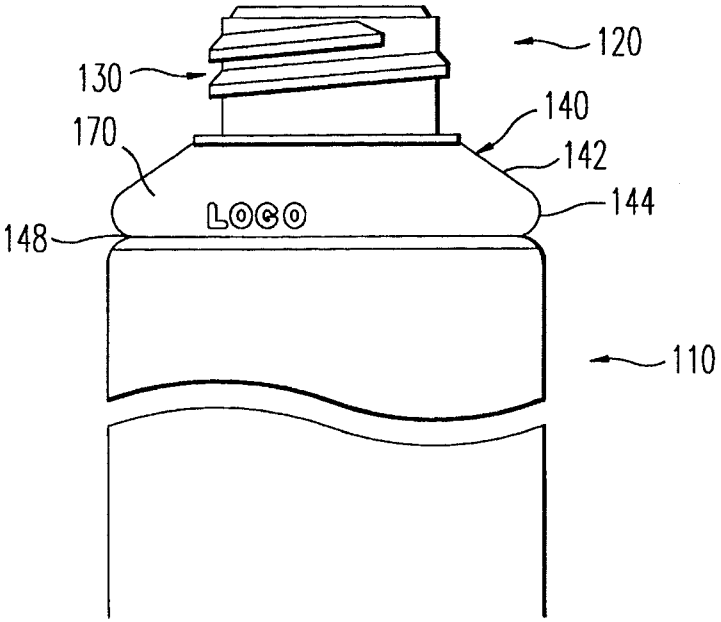
FIG. 3 is a partial elevational view of a container according to the present invention.

Referring to FIGS. 3–5, a container is formed of a flexible tube-shaped sleeve 110 and a dispensing head 120, each of which may be formed in the same way and with the same materials as the containers of FIGS. 1 and 2. The base portion 140 has a truncated conical surface 142 which extends outwardly to form an annular shoulder 144. The annular shoulder defines the radially outermost periphery of the surface 142.

According to the invention, the base portion is extended by a depending portion 146 which extends from the shoulder 144 in a direction away from the tip portion 130. An annular undercut portion 148 having a diameter less than a maximum diameter of the shoulder portion is positioned between the shoulder portion from the depending portion, so that the annular shoulder portion is clearly separated from the depending portion by the undercut portion.

As may be seen most clearly in FIG. 5, the head end 112 of the sleeve 110 extends only to the depending portion 146 and does not reach the shoulder 144 or the undercut portion. The joint portion 150 is thus located below the shoulder portion, and the shoulder portion remains uncovered by the sleeve.

Referring to FIG. 4, a cap 160 is shown threaded onto the tip portion. The cap has a depending skirt 162 whose diameter is substantially equal to that of the sleeve. Nonetheless, since the joint 150 is formed at the depending portion 146 and not at the shoulder 144, the shoulder 144 is exposed, and embossed or recessed indicia 170 formed on the shoulder will not be hidden by either the cap or the sleeve.

Figure 6:
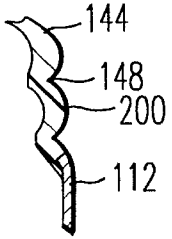
FIG. 6 corresponds to FIG. 5 but shows an alternative embodiment.

The shape of the shoulder is not restricted to that shown in the figures. For example, the shoulder could be angular or faceted, and could, for example, be hexagonal. Also, the depending portion could have a variety of shapes, including an additional annular ring or shoulder 200 upon which indicia could be provided, as shown in FIG. 6. The additional annular ring or shoulder could also have a variety of shapes, and could be, for example, hexagonal.

Referring back to FIG. 4, a shrink wrap is shown at 180. The shrink wrap is an annular band of plastic material which covers only the sides of the cap and the shoulder. The lower end of 182 of the shrink wrap fits into the undercut portion, which thereby provides a grip area which resists removal of the shrink wrap and the cap held therein. The shrink wrap is therefore able to effectively provide tamper protection without its extending over the entire length of the container.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A flexible container for dispensing a product contained therein, comprising:

a flexible tube-shaped sleeve having a closed end and a head end; and a one piece molded dispensing head secured to said head end of said sleeve, said dispensing head comprising:

a) a tip portion through which the product in said container is discharged, b) a substantially truncated conical base portion extending from said tip portion so as to define a substantially annular shoulder portion at an outer periphery thereof, and c) a depending portion depending from said shoulder portion and extending generally away from said tip portion, wherein said head end of said sleeve is secured to, and terminates at, said depending portion so that said shoulder portion is not covered by said sleeve.

2. The container of claim 1, wherein said depending portion defines an annular undercut portion at a side of said shoulder portion opposite said tip portion, said undercut portion having a diameter less than a maximum diameter of said shoulder portion.

3. The container of claim 2, wherein said head end of said sleeve does not cover said undercut portion.

4. The container of claim 1, wherein said dispensing head is formed of molded plastic.

5. The container of claim 4, including indicia molded on said dispensing head.

6. The container of claim 4, wherein said sleeve is formed of extruded plastic and said dispensing head is molded to said head end of said sleeve.

7. The container of claim 3, wherein said depending portion defines at least one annular ring spaced from said shoulder portion by said undercut portion.

8. The container of claim 2, including:

a cap covering said tip portion; and a plastic shrink wrap material covering said cap and extending into said undercut portion.

9. The container of claim 8, wherein said cap has a diameter substantially equal to that of said tube.

10. A flexible container for dispensing a product contained therein, comprising:

a flexible tube-shaped sleeve having a closed end and a head end;

a one piece molded dispensing head molded to said head end of said sleeve and including a tip portion through which the product in said container is discharged and an annular shoulder, wherein said dispensing head is molded to said sleeve such that said annular shoulder is not covered by said sleeve.

11. A flexible container for dispensing a product contained therein, comprising:

a flexible tube-shaped sleeve having a closed end and a head end; and a molded dispensing head non-removably secured to said head end of said sleeve, said dispensing head comprising:

a) a tip portion through which the product in said container is discharged, b) a substantially truncated conical base portion extending from said tip portion so as to define a substantially annular shoulder portion at an outer periphery thereof, and c) a depending portion depending from said shoulder portion and extending generally away from said tip portion, wherein said head end of said sleeve is secured to, and terminates at, said depending portion so that said shoulder portion is not covered by said sleeve.

12. The container of claim 11, wherein said depending portion defines an annular undercut portion at a side of said shoulder portion opposite said tip portion, said undercut portion having a diameter less than a maximum diameter of said shoulder portion.

13. The container of claim 12, wherein said head end of said sleeve does not cover said undercut portion.

14. The container of claim 11, wherein said dispensing head is formed of molded plastic.

15. The container of claim 14, including indicia molded on at least one of said shoulder portion, said truncated conical base and said depending portion.

16. The container of claim 14, wherein said sleeve is formed of extruded plastic and said dispensing head is molded to said head end of said sleeve.

17. The container of claim 13, wherein said depending portion defines at least one annular ring spaced from said shoulder portion by said undercut portion.

18. The container of claim 12, including:

a cap covering said tip portion; and a plastic shrink wrap material covering said cap and extending into said undercut portion.

19. The container of claim 18, wherein said cap has a diameter substantially equal to that of said tube.

* * * * *